US010206268B2

(12) United States Patent
Goodman et al.

(10) Patent No.: US 10,206,268 B2
(45) Date of Patent: Feb. 12, 2019

(54) INTERLACED DATA ARCHITECTURE FOR A SOFTWARE CONFIGURABLE LUMINAIRE

(71) Applicant: ABL IP HOLDING LLC, Conyers, GA (US)

(72) Inventors: Jonathan Lloyd Goodman, Ashburn, VA (US); Hampton Boone Maher, Washington, DC (US)

(73) Assignee: ABL IP HOLDING LLC, Conyers, GA (US)

( * ) Notice: Subject to any disclaimer, the term of this patent is extended or adjusted under 35 U.S.C. 154(b) by 17 days.

(21) Appl. No.: 15/357,143

(22) Filed: Nov. 21, 2016

(65) Prior Publication Data

US 2018/0146533 A1 May 24, 2018

(51) Int. Cl.
*H05B 37/02* (2006.01)
*H05B 33/08* (2006.01)

(52) U.S. Cl.
CPC ..... *H05B 37/0272* (2013.01); *H05B 33/086* (2013.01); *H05B 37/02* (2013.01)

(58) Field of Classification Search
CPC H05B 37/02; H05B 37/0272; H05B 33/0845; H05B 33/0857; G09G 3/3216; G09G 3/3225; G09G 3/3233; G09G 3/3258
See application file for complete search history.

(56) References Cited

U.S. PATENT DOCUMENTS

| | | | | |
|---|---|---|---|---|
| 8,344,410 | B2 * | 1/2013 | Wendler | G06F 3/1446 257/88 |
| 8,441,503 | B2 * | 5/2013 | Isobe | G09G 3/22 345/102 |
| 8,467,887 | B2 * | 6/2013 | Jung | H05B 37/0272 700/17 |
| 8,836,243 | B2 * | 9/2014 | Eisele | H05B 33/0857 315/152 |
| 9,084,305 | B2 * | 7/2015 | Toda | H05B 37/02 |
| 9,642,209 | B2 * | 5/2017 | Eisele | H05B 33/0869 |
| 9,880,328 | B2 | 1/2018 | Gollier et al. | |
| 2003/0169248 | A1 | 9/2003 | Kim et al. | |
| 2004/0160199 | A1 * | 8/2004 | Morgan | A01M 1/04 315/312 |
| 2005/0093783 | A1 * | 5/2005 | Lau | G09G 3/20 345/76 |
| 2007/0294665 | A1 | 12/2007 | Papakipos et al. | |
| 2010/0079361 | A1 * | 4/2010 | Lee | G09G 3/3233 345/77 |

(Continued)

OTHER PUBLICATIONS

Non Final Office Action for U.S. Appl. No. 15/211,272, dated Dec. 27, 2017, 32 pages.

(Continued)

*Primary Examiner* — Tom V Sheng
(74) *Attorney, Agent, or Firm* — RatnerPrestia

(57) ABSTRACT

The examples relate to various representations of data utilized for control of a software configurable lighting device. The software configurable lighting device includes an image display device and a general illumination device. Each data representation includes a pre-defined data structure such that lighting control information and image data may be interlaced within the respective representation.

15 Claims, 7 Drawing Sheets

(56) References Cited

U.S. PATENT DOCUMENTS

| | | | | |
|---|---|---|---|---|
| 2010/0225986 | A1 | 9/2010 | Missbach | |
| 2011/0063201 | A1* | 3/2011 | Karrenbauer | G09G 3/3426 345/102 |
| 2012/0154370 | A1 | 6/2012 | Russell et al. | |
| 2014/0043352 | A1* | 2/2014 | Damberg | H04N 9/3147 345/589 |
| 2015/0192728 | A1 | 7/2015 | Thompson et al. | |
| 2016/0378062 | A1* | 12/2016 | Watanabe | G03H 1/0808 359/9 |

OTHER PUBLICATIONS

Notice of Allowance for U.S. Appl. No. 15/211,272, dated May 23, 2018, 5 pages.
Notice of Allowance for U.S. Appl. No. 15/211,272, dated Jul. 24, 2018, 5 pages.
Final Office Action for U.S. Appl. No. 15/211,272, dated Apr. 16, 2018, 13 pages.

* cited by examiner

INTERLACED DATA ARCHITECTURE FOR A SOFTWARE CONFIGURABLE LUMINAIRE

TECHNICAL FIELD

The present subject matter relates to various representations of data utilized for control of a software configurable lighting device or luminaire wherein each data representation includes a pre-defined data structure such that lighting control information and image data may be interlaced within the respective representation.

BACKGROUND

Electrically powered artificial lighting has become ubiquitous in modern society. Electrical lighting devices are commonly deployed, for example, in homes, buildings of commercial and other enterprise establishments, as well as in various outdoor settings.

In conventional lighting devices, the luminance output can be turned ON/OFF and often can be adjusted up or dimmed down. In some devices, e.g. using multiple colors of light emitting diode (LED) type sources, the user may be able to adjust a combined color output of the resulting illumination. The changes in intensity or color characteristics of the illumination may be responsive to manual user inputs or responsive to various sensed conditions in or about the illuminated space.

There have been proposals to use displays or display-like devices mounted in or on the ceiling to provide lighting. The Fraunhofer Institute, for example, has demonstrated a lighting system using luminous tiles, each having a matrix of red (R) LEDs, green (G), blue (B) LEDs and white (W) LEDs as well as a diffuser film to process light from the various LEDs. The LEDs of the system were driven to simulate or mimic the effects of clouds moving across the sky. Although use of displays allows for variations in appearance that some may find pleasing, the displays or display-like devices are optimized for image output and do not provide particularly good illumination for general lighting applications. Liquid crystal displays (LCD) also are rather inefficient and thus not readily adaptable to artificial illumination applications. Even if display or display like devices may be adapted in some fashion for use as artificial illumination, operating such a device to provide a display capability and associated general lighting performance may place high demands on the data processing capabilities of the device. In addition, providing such display capability and associated general lighting performance requires that image data and lighting control information be delivered to the device. In order to improve efficiency of delivery of image data and lighting control information, new data representations are needed to enable interleaving of the image data and lighting control information.

SUMMARY

An example of a configurable luminaire as disclosed herein includes a controllable, general illumination, light source comprising a plurality of light pixels; a driver system coupled to the light source and configured to supply drive power to the light source in a manner to control general illumination light output by each pixel of the light source; and a processor coupled to the driver system. The configurable luminaire also includes data related to operation of the configurable luminaire representing lighting control information for general illumination light output. The data is separable into portions, each of at least some of the portions containing data representing lighting control information. In addition, the processor is configured to implement functions to obtain each portion containing data representing lighting control information and for each obtained portion, control a corresponding one light pixel based on the respective portion for general illumination light output by the light source.

Some of the described examples disclose a method including obtaining each portion of data from data related to operation of a configurable luminaire, in which the data is separable into portions. The configurable luminaire comprises a controllable, general illumination, light source comprising a plurality of light pixels, a driver system coupled to the light source and configured to supply drive power to the light source in a manner to control general illumination light output by the light source, and a processor coupled to the driver system. The data comprises data representing control information for general illumination light output, and each portion of the data that contains data representing control information corresponds to one light pixel of the configurable luminaire. For each portion containing data representing control information, the method also entails controlling a corresponding light pixel based on the respective portion, for general illumination light output by the light source.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
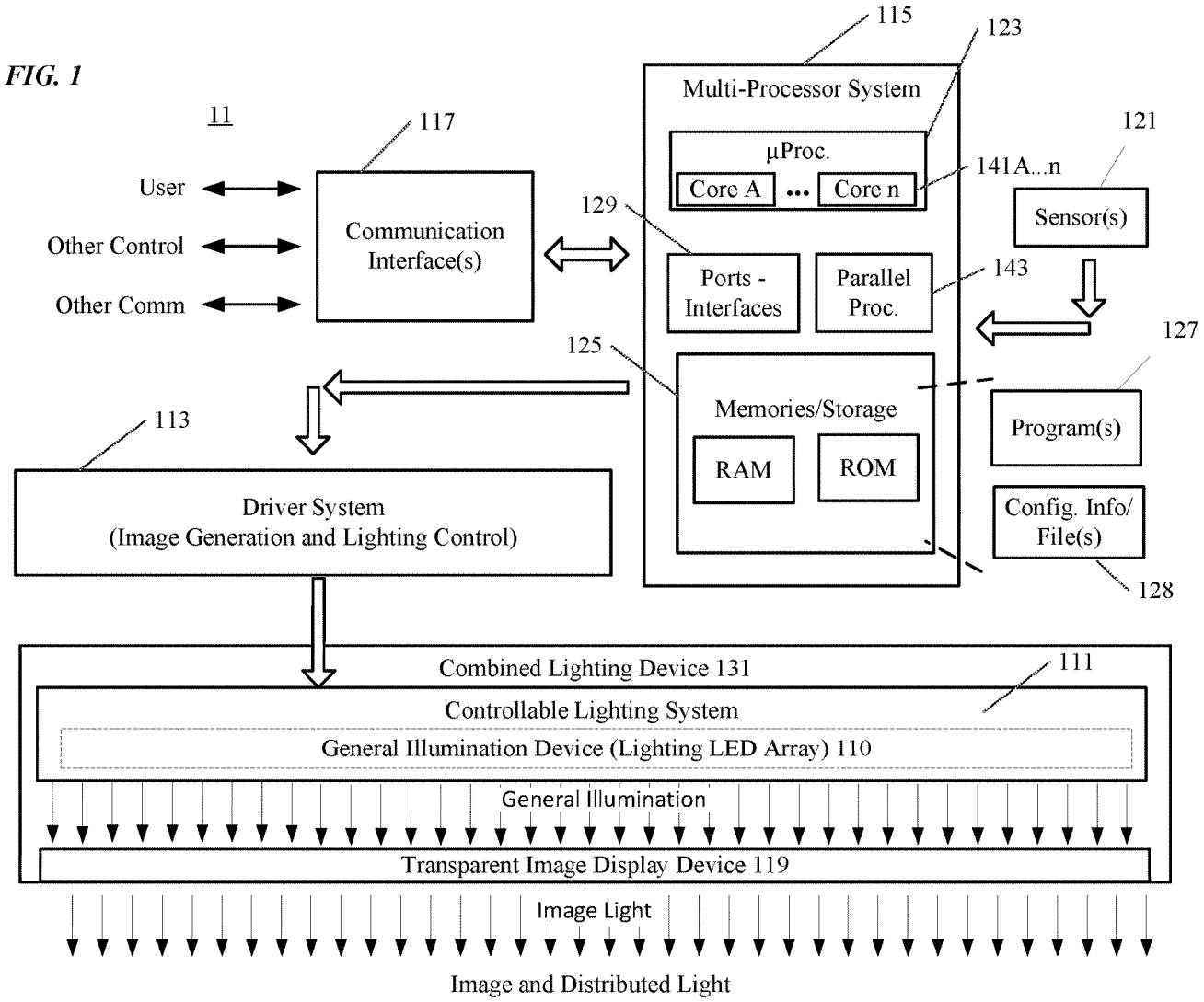
FIG. 1 is high-level functional block diagram of an example of a software configurable luminaire with a multi-processor system, for example, including a multi-threaded central processing unit and a parallel processing unit.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Applicant has recently developed proposals directed to luminaires utilizing transparent image displays that allow an image to be displayed while remaining at least partially transparent. In particular, such a transparent image display is collocated with a general illumination device, and illumination generated by the general illumination device "passes through" the transparent image display. In such a combined lighting device, image data related to an image to be displayed by the transparent image display and/or control data related to illumination generation may be needed. That is, image data related to the image to be displayed is needed while control data related to illumination generation may also be needed. At the same time, however, any image data needs to be identifiable and separable from any control data.

One approach has been to maintain image data separately from control data. For example, an image to be displayed may be stored in a single file and/or maintained in a single portion of memory while control data may be stored in a separate file and/or maintained in another portion of memory. However, such separation in individual files or individual portions of memory increases the amount of file and/or memory management overhead.

In order to reduce such file and/or memory management overhead, approaches have been developed to maintain image data interlaced with control data. In addition, various data representations have been defined to enable any image data to be identified and/or separated from any control data.

Various examples described in detail below and shown in the drawings implement enhancements to existing display technologies to provide the dual functionality of a display and luminaire, particularly in a manner to more effectively support luminaire type general lighting applications. In one such example, a combined lighting device includes a transparent image display device and a controllable lighting system. In addition, various examples described in detail below and shown in the drawings enable image data and control data for use by the combined lighting device to be maintained and/or communicated in an interlaced fashion.

A software configurable lighting device, installed for example as a panel, offers the capability to emulate a variety of different lighting devices while presenting any desired appearance via image display. The operation of such software configurable lighting device is enhanced by enabling the efficient management of image data and lighting control information.

Reference now is made in detail to the examples illustrated in the accompanying drawings and discussed below. As shown in FIG. 1, the controllable lighting system 111 provides general illumination lighting via general illumination device 110 in response to lighting control signals received from the driver system 113. Similarly, the transparent image display device 119 provides image light in response to image control signals received from the driver system 113. In addition or alternatively, the image data may be provided to the image display device 119 from an external source(s) (not shown), such as a remote server or an external memory device via one or more of the communication interfaces 117. The elements 111, 110 and 119 are collocated to form combined lighting device 131 and are controlled by the respective control signals received from the driver system 113.

The transparent image display device 119 may be either a commercial-off-the-shelf image display device or an enhanced transparent image display device (described in more detail in the following examples) that allows general illumination lighting generated by general illumination device 110 to pass through. The general illumination lighting alone or in combination with light output from the display illuminates a space in compliance with governmental building codes and/or industry lighting standards. The image display device 119 is configured to present an image. The presented image may be a real scene, a computer generated scene, a single color, a collage of colors, a video stream, or the like.

In several examples, the general illumination device 110 includes a lighting LED array configured to provide light for the general illumination function. The controllable lighting system 111 is collocated with the image display device 119 to form a combined lighting device 131. However, as mentioned above and discussed in greater detail below, the image display device utilized image data to present an image while the general illumination device generates general illumination based on lighting control information (e.g., intensity and color temperature). As such, an approach to managing both image data and lighting control information in an interlaced fashion is needed.

In one example of the operation of the lighting device, the multi-processor system 115 receives a configuration file 128 via one or more of communication interfaces 117. The multi-processor system 115 may store, or cache, the received configuration file 128 in storage/memories 125. The configuration file 128 includes data related to operation of the configurable lighting device that indicates, for example, an image for display by the image display device 119 (e.g., image pixel data representing points of the image) as well as a general lighting generation selection (e.g., control data controlling intensity of general illumination). A general lighting generation selection includes, for example, lighting settings for light to be provided by the controllable lighting system 111. Using the indicated image data, the multi-processor system 115 may retrieve from memory 125 stored image data and, based on a desired color characteristic distribution consistent with the lighting settings of the general lighting generation selection, transform image data to produce transformed image data. That is, as discussed in greater detail below, the image selection is transformed such that an output of the image display device 119, in combination with light generated by the controllable lighting system 111, results in a desired image and desired general illumination. The transformed image data is then delivered to the driver system 113.

The driver system 113 may deliver the transformed image data directly to the image display device 119 for presentation or may have to convert the image data into a format suitable for delivery to the image display device 119. For example, the transformed image data may be video data formatted according to compression formats, such as H.264 (MPEG-4

Part 10), HEVC, Theora, Dirac, RealVideo RV40, VP8, VP9, or the like, and still transformed image data may be formatted according to compression formats such as Portable Network Group (PNG), Joint Photographic Experts Group (JPEG), Tagged Image File Format (TIFF) or exchangeable image file format (Exif) or the like. For example, if floating point precision is needed, options are available, such as OpenEXR, to store 32-bit linear values. In addition, the hypertext transfer protocol (HTTP), which supports compression as a protocol level feature, may also be used.

Each general lighting generation selection includes software control data to set the light output parameters of the software configurable lighting device at least with respect to the controllable lighting system 111. As mentioned, the configuration information in the file 128 may specify operational parameters of the controllable lighting system 111, such as light intensity, light color characteristic and the like, as well as the operating state of any light processing and modulation components of the controllable lighting system 111. The multi-processor 115 by accessing programming 127 and using software configuration information 128, from the storage/memories 125, modifies operational parameters of the general lighting generation selection based on the transformed image data to create a modified general lighting generation selection. The multi-processor system 115 controls, based on the modified general lighting generation selection, operation of the driver system 113, and through that system 113 controls the controllable lighting system 111. For example, the multi-processor system 115 obtains light intensity distribution control data as part of the general lighting generation selection from the configuration file 128. In turn, multi-processor system 115 modifies the obtained light intensity distribution control data of the general lighting generation selection based on transformed image data to be displayed by transparent image display device 119. Next, multi-processor system 115 uses that modified control data to control the driver system 113 to set operating states of the light processing and modulation components of the controllable lighting system 111. For example, driver system 113 drives controllable lighting system 111 to control output of general illumination device 110 to produce a selected distribution of varying intensities of LEDs within general illumination device 110, e.g. to achieve a predetermined light generation for a general illumination application of a luminaire.

In other examples, the driver system 113 is coupled to the memory 125, the image display device 119 and the controllable lighting system 111 to control light generated by the image display device 119 and the controllable lighting system 111 based on the configuration data 128 stored in the memory 125. In such an example, the driver system 113 is configured to access configuration data 128 stored in the memory 125 and generate control signals for presenting a transformed image on the image display device 119 and control signals based on a modified general lighting generation selection for generating light for output from the general illumination device 110. For example, the image display device 119 includes inputs coupled to the driver system 113 for receiving image data according to the configuration data 128 stored in the memory. Examples of the image data includes video data or still image data stored in the memory 125. The driver system 113 may also deliver control signals for presenting the image on the image display device 119 that are generated based on the received image data.

The first drawing also provides an example of an implementation of the high layer logic and communications elements and one or more drivers to drive the combined lighting device 131 to provide a selected distribution of light intensities, e.g. for a general illumination application. As shown in FIG. 1, the lighting device 11 includes a driver system 113, a multi-processor system 115, one or more sensors 121 and one or more communication interface(s) 117.

The multi-processor system 115 provides the high level logic or "brain" of the device 11. In the example, the multi-processor system 115 includes data storage/memories 125, such as a random access memory and/or a read-only memory, as well as programs 127 stored in one or more of the data storage/memories 125. Such programs 127 include, for example, instructions necessary to perform transformation of an image selection and/or modification of a general lighting generation selection. The data storage/memories 125 store various data, including lighting device configuration information 128 or one or more configuration files containing such information, in addition to the illustrated programming 127. The multi-processor system 115 also includes a central processing unit (CPU), shown by way of example as a microprocessor (μP) 123, although other processor hardware may serve as the CPU. In addition, multi-processor system 115 includes a parallel processor 143.

CPU 123 includes, for example, multiple cores A-n 141A-n. Although CPU 123 is depicted with multiple cores, this is only for example and no such requirement exists. Alternatively, CPU 123 may be a single processor with a single core. In various examples, CPU 123 supports multiple threads where each thread represents an independent processing path. For example, each core A-n 141A-n of CPU 123 supports one or more threads of processing. Similarly, a single core processor may also support multiple threads. In various examples, CPU 123 is configured to perform serialized tasks. That is, a first task is performed first and a second task, independent of the first task, is performed second. In some examples, the first task is performed by one core of CPU 123 while the second task is performed by another core of CPU 123. In other words, even though the tasks are serialized and independent, multiple tasks may be performed during a single processing cycle by use of multiple cores or multiple threads. Said another way, given multiple processing cores or a single multi-threaded core, multiple different independent serialized tasks may be performed simultaneously.

In contrast to CPU 123 which is configured to perform serialized tasks, parallel processor 143 is configured to perform a plurality of operations during a same processing cycle. For example, given a number of data points and the same processing to be performed for each data point, parallel processor 143 performs that same processing on the number of data points at the same time or otherwise in parallel. As a further example, image data and/or control data for general illumination may be divided into various portions, with each portion corresponding to a pixel (e.g., an image pixel and/or an illumination pixel). In order to transform the image data and/or modify the control data, each portion of data corresponding to a pixel must be processed in the same way. Instead of processing data corresponding to a first pixel and then processing data corresponding to a second pixel, as might be done in the serialized fashion of CPU 123, parallel processor 143 performs the same processing on each portion during the same processing cycle. As a result, the entire image data is transformed and/or all of the control data is modified during the same processing cycle, thereby improving efficiency of multi-processor system 115. Parallel processor 143 is, for example, a graphics processing unit (GPU), a field programmable gate array (FPGA) or an application specific integrated circuit (ASIC). In a further example, the GPU includes a number of tile-based processors or stream-based processors.

In FIG. 1, the ports and/or interfaces 129 couple the multi-processor system 115 to various elements of the device 11 logically outside the multi-processor system 115, such as the driver system 113, the communication interface (s) 117 and the sensor(s) 121. For example, the multi-processor system 115 by accessing programming 127 in the memory 125 controls operation of the driver system 113 and other operations of the lighting device 11 via one or more of the ports and/or interfaces 129. In a similar fashion, one or more of the ports and/or interfaces 129 enable the multi-processor system 115 to use and communicate externally via the interfaces 117; and the one or more of the ports 129 enable the multi-processor system 115 to receive data regarding any condition detected by a sensor 121, for further processing.

In the examples, based on its programming 127, the multi-processor system 115 processes data retrieved from the memory 125 and/or other data storage, and responds to light output parameters in the retrieved data to control the combined lighting device 131. The light output control also may be responsive to sensor data from a sensor 121. The light output parameters may include light intensity and light color characteristics in addition to spatial modulation (e.g. steering and/or shaping and the like for achieving a desired spatial distribution).

As noted, the multi-processor system 115 is coupled to the communication interface(s) 117. In the example, the communication interface(s) 117 offer a user interface function or communication with hardware elements providing a user interface for the device 11. The communication interface(s) 117 may communicate with other control elements, for example, a host computer of a building control and automation system (BCAS). The communication interface(s) 117 may also support device communication with a variety of other systems of other parties, e.g. the device manufacturer for maintenance or an on-line server for downloading of virtual luminaire configuration data.

As outlined earlier, the multi-processor system 115 also is coupled to the driver system 113. The driver system 113 is coupled to the combined lighting device 131 to control one or more operational parameter(s) of the light output generated by the controllable lighting system 111. Although the driver system 113 may be a single integral unit or implemented in a variety of different configurations having any number of internal driver units, the example of system 113 may include a separate general illumination device driver (not shown) and a separate image display driver (not shown). The separate drivers may be circuits configured to provide signals appropriate to the respective type of light source and/or modulators of the combined lighting device 131 utilized in the particular implementation of the device 11, albeit in response to commands or control signals or the like from the multi-processor system 115.

The multi-processor system 115 and the driver system 113 provide a number of control functions for controlling operation of the lighting device 11. In a typical example, execution of the programming 127 by the multi-processor system 115 and associated control via the driver system 113 configures the lighting device 11 to perform functions, including functions to operate the general illumination device 110 to provide light output from the lighting device and to operate the controllable lighting system 111 to steer and/or shape the light output from the source so as to distribute the light output from the lighting device 11 to emulate a lighting distribution of a selected one of a number of types of luminaire, based on the lighting device configuration information 128.

Apparatuses implementing functions like those of device 11 may take various forms. In some examples, some components attributed to the lighting device 11 may be separated from the combined lighting device 131. For example, an apparatus may have all of the above hardware components on a single hardware device as shown or in different somewhat separate units. In a particular example, one set of the hardware components may be separated from the combined lighting device 131, such that the multi-processor system 115 may run several similar systems of sources and modulators from a remote location. Also, one set of intelligent components, such as the multi-processor system 115, may control/drive some number of driver systems 113 and associated combined lighting devices 131. It also is envisioned that some lighting devices may not include or be coupled to all of the illustrated elements, such as the sensor(s) 121 and the communication interface(s) 117. For convenience, further discussion of the device 11 of FIG. 1 will assume an intelligent implementation of the device that includes at least the illustrated components.

In addition, the device 11 is not size restricted. For example, each device 11 may be of a standard size, e.g., 2-feet by 2-feet (2×2), 2-feet by 4-feet (2×4), or the like, and arranged like tiles for larger area coverage. Alternatively, the device 11 may be a larger area device that covers a wall, a part of a wall, part of a ceiling, an entire ceiling, or some combination of portions or all of a ceiling and wall.

Lighting equipment like that disclosed in the examples of FIG. 1 may be used in combinations of an image display device and other light sources, e.g. as part of the same fixture for general illumination, but not part of or integrated into the image display device. Although the image display device and general illumination device may be of any of the various respective types described here, for discussion purposes, we will use an example of a fixture that has an image display combined with a general illumination device, i.e., a controllable additional light source. For this purpose, 1A illustrates examples of components to be included in a combined lighting device 131.

Figure 1A:
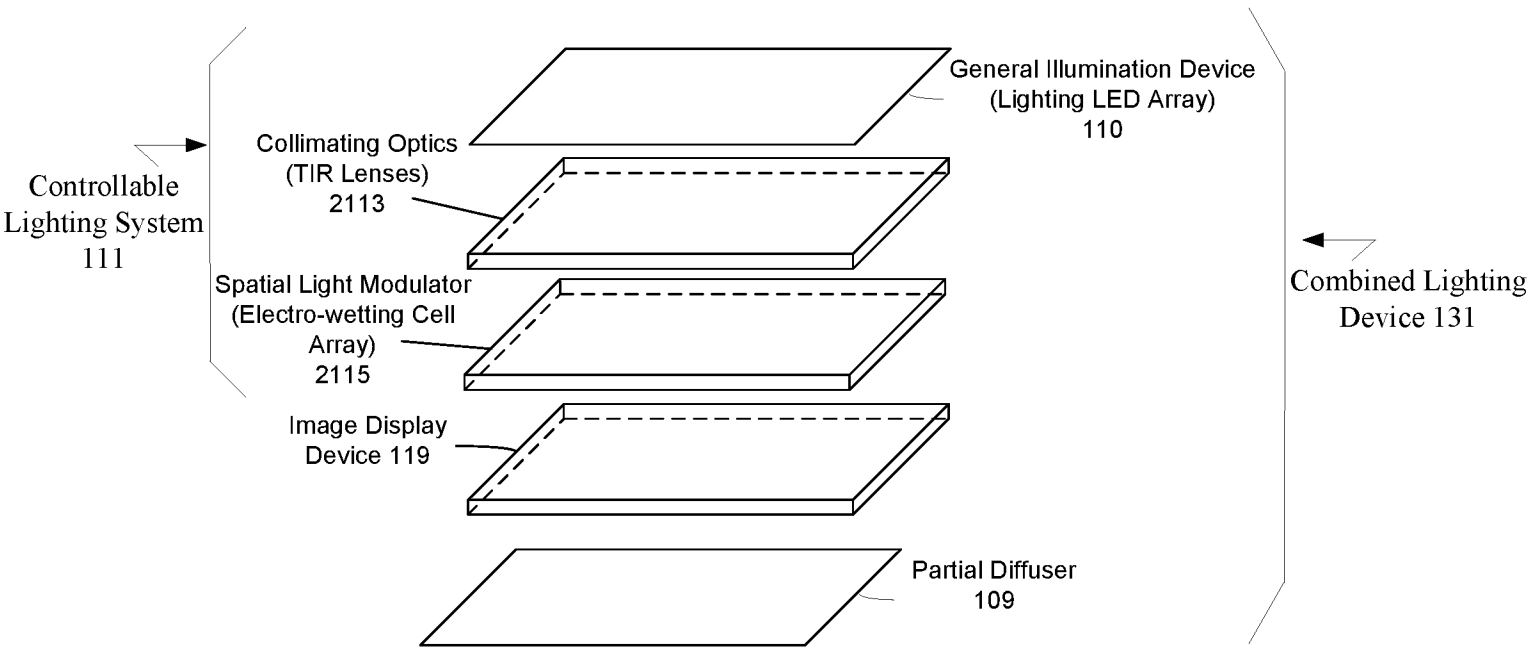
FIG. 1A is an illustration of components of an enhanced controllable lighting system, such as may be used in the software configurable luminaire of FIG. 1.

In the example of FIG. 1A, combined lighting device 131 includes controllable lighting system 111 and image display device 119. The combined lighting device 131 optionally includes partial diffuser 109 placed so as to cover image display device 119 and partially diffuse light generated by both image display device 119 and controllable lighting system 111. In one example, partial diffuser 109 is a holographic type where the diffusion angle can be controlled to be a few degrees, such that the lighting distribution is not significantly affected by it, but at the same time can hide some features of the layers behind it that would otherwise be more visible since the display layer is partially transparent.

Controllable lighting system 111 includes general illumination device 110. In one example, general illumination device 110 includes an array of LEDs configured to emit light for general illumination within a space. In the example of FIG. 1A, the controllable lighting system 111 also optionally includes collimating optics 2113 and/or spatial light modulator 2115. Collimating optics 2113 is formed, for example, with a collection of total internal reflection (TIR) lenses. Collimating optics 2113 enable light emitted by general illumination display 110 to be coupled more efficiently to transparent regions of image display device 119 and/or spatial light modulator 2115. Spatial light modulator 2115 is, for example, an electro-wetting cell array. Spatial light modulator 2115 enables light emitted by general illumination device 110, and optionally collimated by collimating optics 2113, to be shaped and/or steered for general illumination within a space.

As noted with regard to FIG. 1A, the controllable lighting system 111 may also include a controllable spatial light modulator 2115 for processing the emitted light according to the modified general lighting generation selection. To explain in more detail by way of example, the controllable lighting system 111 may receive control signals from the driver system 113 that control beam steering/beam shaping by spatial light modulator 2115 to process light with a particular beam steering and/or beam shaping process to provide a desired spatial distribution of general illumination.

As shown in the cross-sectional view of FIG. 1A, each of the controllable lighting systems 111 is formed by a general illumination display 110 optionally in combination with collimating optics 2113 and/or a spatial light modulator 2115. Each combination of a general illumination display 110, collimating optics 2113 and a spatial light modulator 215 operates and is controlled essentially as described by way of example above, to produce a distributed light output suitable for general illumination.

In the example of FIGS. 1 and 1A, the image light and/or general illumination light from the image display device 119 provides an image visible to a person within the space in which the lighting device 11 is installed. The intensity and/or color characteristics of the image and/or light output of the image display device 119 may be selectively controlled, however, there is no direct spatial modulation of image light. Light, however, is additive. The light output of controllable lighting system 111 is selectively modulated. Hence, in an example like that shown in FIGS. 1 and 1A, the combination of light from the image display and light from the controllable lighting system 111 can be controlled to emulate a lighting distribution of a selected one of a variety of different luminaires. More specifically, an image to be displayed is transformed based on a desired color characteristic distribution while general lighting generation control data is modified based on the transformed image such that the combination of the display of the transformed image and general illumination produced by the modified control data provides a desired result. In addition, data necessary to control modulation of spatial light modulator 2115, if present, is calculated based on user selection.

In the examples we have been considering so far, a multi-processor system 115 configures the lighting device 11 to provide light output from the image display device 119 and to operate the controllable lighting system 111 to provide general illumination that substantially emulates a lighting distribution of a selected one of a number of types of luminaire, based on the lighting device configuration information.

As described herein, a software configurable lighting device 11 (e.g. FIG. 1) of the type described herein can store configuration information for one or more luminaire output distributions. A user may define the parameters of a distribution in the lighting device 11, for example, via a user interface on a controller or user terminal (e.g. mobile device or computer) in communication with the software configurable lighting device 11. In another example, the user may select or design a distribution via interaction with a server, e.g. of a virtual luminaire store; and the server communicates with the software configurable lighting device 11 to download the configuration information for the selected/designed distribution into the lighting device 11. When the software configurable lighting device 11 stores configuration information for a number of lighting distributions, the user operates an appropriate interface to select amongst the distributions available in the software configurable lighting device 11. Selections can be done individually by the user from time to time or in an automatic manner selected/controlled by the user, e.g. on a user's desired schedule or in response to user selected conditions such as amount of ambient light and/or number of occupants in an illuminated space.

In addition, the data to be utilized by a software configurable luminaire (e.g., image data, control data, modulation data) may be stored and referenced and/or communicated in a number of different ways. In particular, image data and control data may be interlaced or otherwise intermixed within a single set of data, such as data within a single portion of memory. Alternatively, image data may be maintained separately from control data or modulation data (i.e., image data in one portion of memory, control data in another portion of memory, and modulation data in yet a different portion of memory), yet managed in an integrated fashion. FIGS. 2-7 depict examples of different representations of data to be utilized in a software configurable luminaire and processes for utilizing such data.

Before discussing the specific examples of FIGS. 2-7, it may be helpful to review typical structures for image data and control data. In general, an image may be viewed as a collection of image pixels, where each image pixel projects a particular color at a particular intensity. The color to be projected by a particular image pixel is often defined as a combination of primary colors, most often red (R), green (G) and blue (B); although other combinations exists, such as cyan (C), magenta (M), yellow (Y) and black (K). Thus, one image pixel may be defined by an RGB value representing an amount of R, an amount of G and an amount of B to be combined. If the values correspond to actual intensity; together, the RGB values also define a combined intensity for the pixel output. If the RGB values are relative values, e.g. percentages or ratios, then the data may also specify a value for intensity of the combined light output of the pixel.

Similarly, an array of emitters to generate general illumination may also be viewed as a collection of illumination pixels, where each illumination pixel projects a particular chromaticity with a specified intensity. Although chromaticity for illumination may be perceived as a particular color, illumination chromaticity is often defined as a coordinate on an x,y color coordinate system. Hence, an illumination pixel may be defined by an xyY value representing chromaticity (i.e., xy) and intensity (i.e., Y). Alternatively or in addition, given "white" or other "single color" emitters, intensity data may be sufficient to drive general illumination generation in a particular software configurable luminaire.

As can be seen, even though output of an image pixel and output of an illumination pixel may each be defined based on a different interpretation of data, the underlying data may be represented in an otherwise "common" format. That is, each pixel, whether image or illumination, may be defined by a collection of data points and, for a series of pixels, each series of like data points forms a channel (e.g., an R/x channel, a G/y channel and a B/Y channel). As such, the examples depicted in FIGS. 2-7 define the number and/or nature of individual channels utilized to manage and/or manipulate data in a software configurable luminaire capable of display and illumination functions.

Of note, in the examples of FIGS. 2-5, the defined number and/or nature of individual channels is pre-defined. That is, in any one example, all data is maintained in the same manner (e.g., image data for a first image is interlaced with lighting control data in the same manner as image data for a second image). In contrast, in the examples of FIGS. 6-7, the various channels are represented as a string of values in a one-dimensional array (e.g., $R_1$, $G_1$, $B_1$, $R_2$, $G_2$, $B_2$ . . . $R_n$, $G_n$, $B_n$) along with a data header that defines, as described in greater detail below, the relationship between various cells within the array. As such, not all data need be maintained in the same manner. For example, one set of data (i.e., one array with one data header) may include image data and lighting control information interlaced while another set of data (i.e., another array with another data header) may include only lighting control information or only image data. Further in this example, an additional set of data (i.e., an additional array with an additional data header) may include image data and lighting control information interlaced, but in a different fashion from that of the one set of data.

Figure 2:
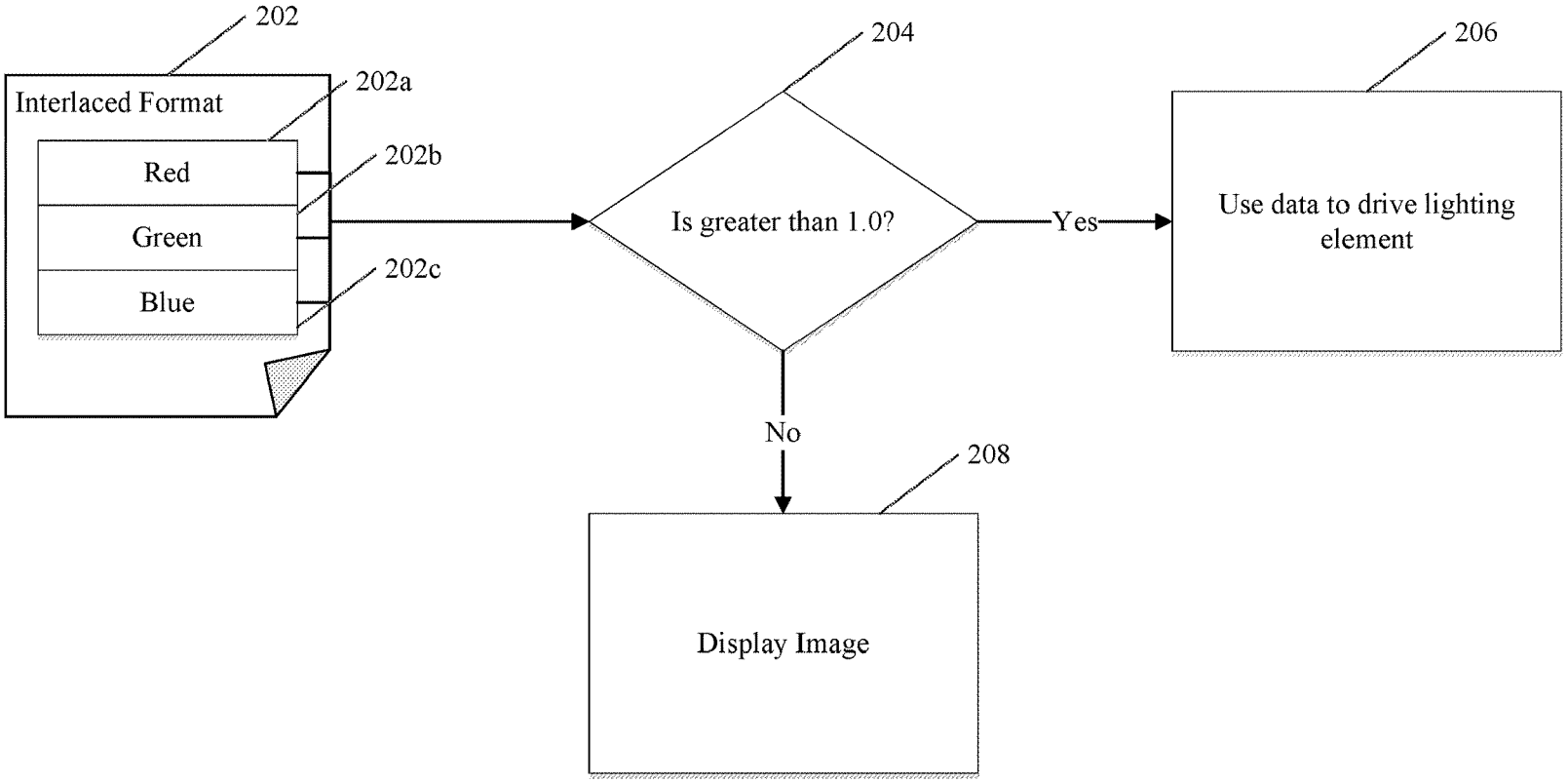
FIGS. 2-5 illustrate examples of various approaches for managing and interpreting interlaced data.

FIG. 2 depicts one example of an approach to manage data to be utilized in a software configurable luminaire. In this example, three channels are utilized to represent the data, with each channel including a series of values. Each value is, for example, a floating point value with a 16-bit depth. Alternatively, each value is an integer or floating point value with a different depth (e.g., 32-bit, 64-bit, etc.). At 202, control data and image data are maintained in an interlaced fashion. For example, the first channel includes a series of values representing R, the second channel includes a series of values representing G and the third channel includes a series of values representing B. In order to define a pixel, either image or illumination, one value is taken from each of the three channels (i.e., a set of RGB values).

In 204, the set of three values taken from the three channels is evaluated. If the three values are each less than 1, then the three values correspond to an image pixel in 208. In this situation, the RGB values may be converted into XYZ tristimulus values and in turn converted into xyY colorspace. The conversion from RGB into XYZ may utilize the following formula $$\begin{bmatrix} X \\ Y \\ Z \end{bmatrix} = [M] \begin{bmatrix} R \\ G \\ B \end{bmatrix}$$

in which the matrix M may vary depending on the RGB working space. For example, given the sRGB working space, the matrix M is $$\begin{bmatrix} 0.4124564 & 0.35735761 & 0.1804375 \\ 0.2126729 & 0.7151522 & 0.0721750 \\ 0.0193339 & 0.1191920 & 0.9503041 \end{bmatrix}$$

Furthermore, the conversion from XYZ into xyY may utilize the following formulas.

$$x = \frac{X}{X+Y+Z}$$
$$y = \frac{Y}{X+Y+Z}$$
$$Y = Y$$

Otherwise, if the three values are each greater than 1, then the three values correspond to an illumination pixel in 206. In this situation, the RGB values may be scaled to a range of 0-1.0 and then converted into xyY colorspace after conversion into XYZ tristimulus values. Although not explicitly shown, each set of three RGB values contained in the three channels is evaluated to determine whether the set corresponds to an image pixel or an illumination pixel. In this way, RGB values corresponding to image pixels and RGB values corresponding to illumination pixels are interlaced throughout the three channels.

Figure 3:
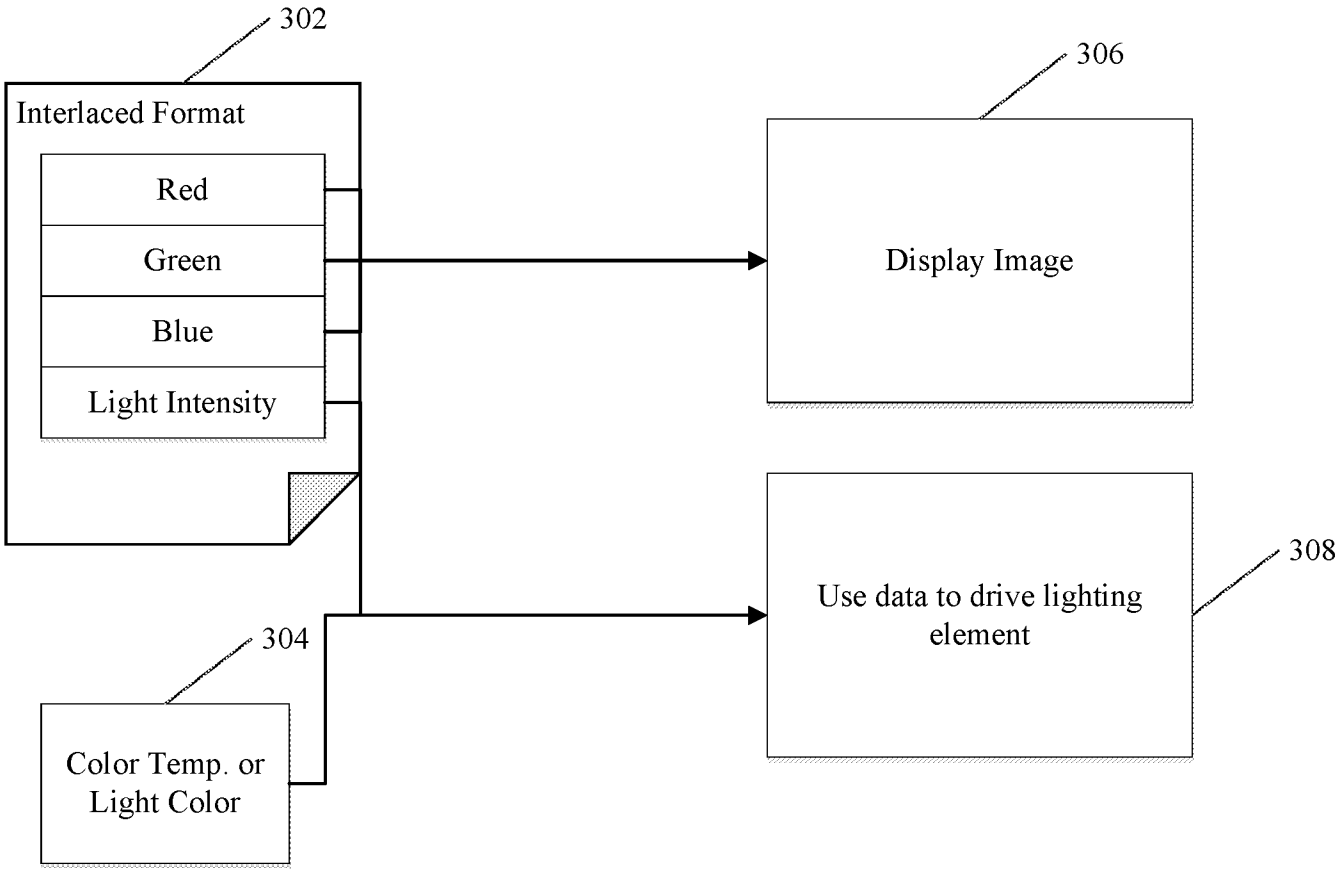

FIG. 3 depicts another example of an approach to manage data to be utilized in a software configurable luminaire. In this other example, four channels are utilized to represent some portion of the data, with each channel including a series of values. Each value is, for example, a floating point value with a 16-bit depth. Alternatively, each value is an integer or floating point value with a different depth (e.g., 32-bit, 64-bit, etc.). However, unlike the approach of FIG. 2 where data corresponding to an image pixel is intermixed within the same channels as data corresponding to an illumination pixel, three of the channels at 302 correspond exclusively to RGB values representing image data displayed at 306 while one channel at 302 corresponds to intensity data for use in general illumination generation at 308. In one example, the four channels of interlaced data at 302 is represented as a one-dimensional array of values (e.g., $R_1$, $G_1$, $B_1$, $I_1$, $R_2$, $G_2$, $B_2$, $I_2$ . . . $R_n$, $G_n$, $B_n$, $I_n$). Separately, color temperature or light color data is maintained, at 304, for use in general illumination generation at 308.

Figure 4:
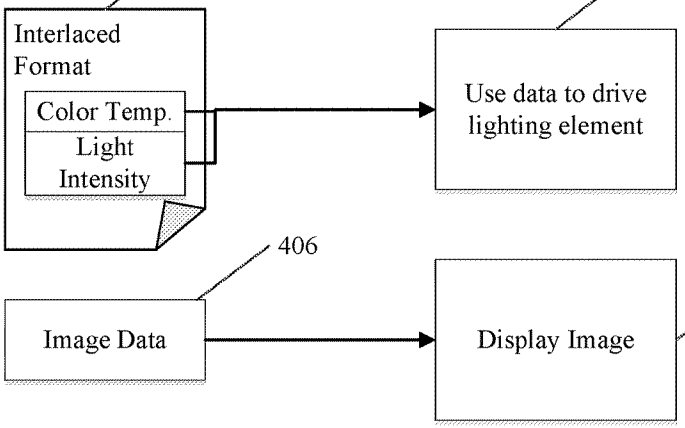

FIG. 4 depicts yet another example of an approach to manage data to be utilized in a software configurable luminaire. For example, two channels are utilized to represent some portion of the data, with each channel including a series of values. Each value is, for example, a floating point value with a 16-bit depth. Alternatively, each value is an integer or floating point value with a different depth (e.g., 32-bit, 64-bit, etc.). In this example, image data is maintained separately at 406 to be displayed at 408. At 402, one channel includes color temperature data and the other channel includes light intensity data for use in general illumination generation at 404. As such, only data corresponding to illumination pixels is interlaced within a single data set. However, as with the examples of FIGS. 2-3 and 5, the two channels of interlaced data at 402 is, for example, represented as a one-dimensional array of values (e.g., $C_1$, $I_1$, $C_2$, $I_2$ . . . $C_n$, $I_n$).

Figure 5:
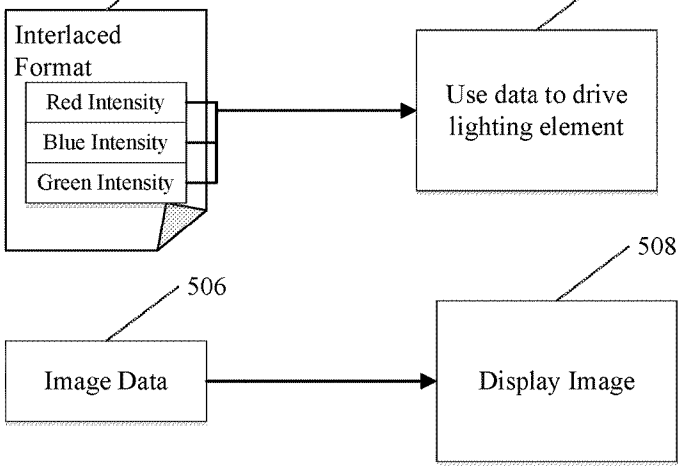

FIG. 5 depicts a further example of an approach to manage data to be utilized in a software configurable luminaire. Similar to the example of FIG. 4, image data is maintained separately at 506 for display at 508. Unlike the example of FIG. 4, three channels are utilized to represent red intensity, blue intensity and green intensity at 502 for use in generating general illumination at 504. The three channels of intensity data are represented, for example, as a one-dimensional array of values.

Although not explicitly depicted in the examples of FIGS. 2-5, over time, additional data may be utilized by the software configurable lighting device. For example, the lighting device might present one image for a period of time and then present a different image for a subsequent period of time. Similarly, the lighting device might generate general illumination in one fashion for a period of time and then generate general illumination in a different fashion for a subsequent period of time. However, in any one example, all data is maintained in the same manner. For example, if the interlaced format depicted in FIG. 2 is utilized during a first time period to interpret a first set of data, that same interlaced format is also utilized during any subsequent time period to interpret any subsequent set of data. Alternatively, or in addition, any transition between different interlaced formats needs to be coordinated such that the lighting device is prepared to interpret the data differently.

Figure 6:
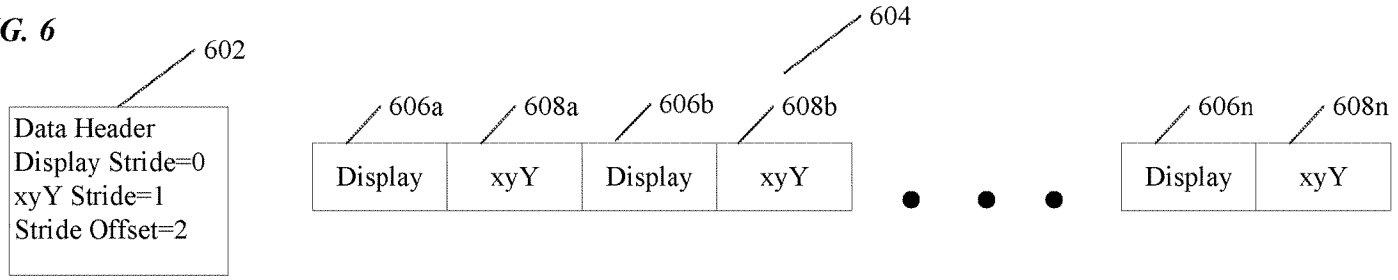
FIG. 6 illustrates an example of another approach for managing and interpreting interlaced data.

FIG. 6 depicts another example of an interlaced data format. In this example, each portion of image data (i.e., one display pixel) is maintained in a corresponding display data cell 606*a*, 606*b* . . . 606*n* of an array data structure 604 while each portion of lighting control information (i.e., one light pixel) is maintained in a corresponding lighting data cell 608*a*, 608*b* . . . 608*n* of the array data structure 604. In addition, a data header 602 includes information defining a relationship between data cells of the array data structure 604. For example, the data header 602 includes an indication that image data for one display pixel is maintained in a first data cell 606*a* and an indication that lighting control information for one lighting pixel is maintained in a second data cell 608*a*. In addition, the data header 602 includes, for example, an offset as an indication of a number of data cells utilized to maintain data for one display pixel and one lighting pixel. In the example of FIG. 6, such offset is 2 because each display pixel corresponds to one cell and each lighting pixel corresponds to one cell.

Although FIG. 6 depicts a relationship of one cell corresponding to one display pixel and one cell corresponding to one lighting pixel, this is only for illustrative purposes and is not the only possible relationship. For example, an alternative relationship may indicate that one display data cell corresponds to one display pixel (e.g., each display cell contains 3 RGB values) and two lighting data cells correspond to one lighting pixel (e.g., each lighting pixel utilizes one data cell containing an intensity value and one data cell containing a color temperature value). In this example, the offset has a value of 3. Furthermore, because a set of data (e.g., array data structure 604) includes a data header (e.g., data header 602), any two sets of data need not have the same relationship. For example, during one time period, a lighting device may utilize a data set that includes both image data and lighting control data, such as depicted in FIG. 6. However, during a subsequent time period, the lighting device may utilize a subsequent data set that only includes image data (e.g., the prior image is to be replaced with a subsequent image while general illumination remains the same) or only includes lighting control data (e.g., general illumination is to be changed while the displayed image remains the same). As such, the interlaced format depicted in FIG. 6 provides flexibility in maintaining data to be utilized by a software configurable luminaire.

Figure 7:
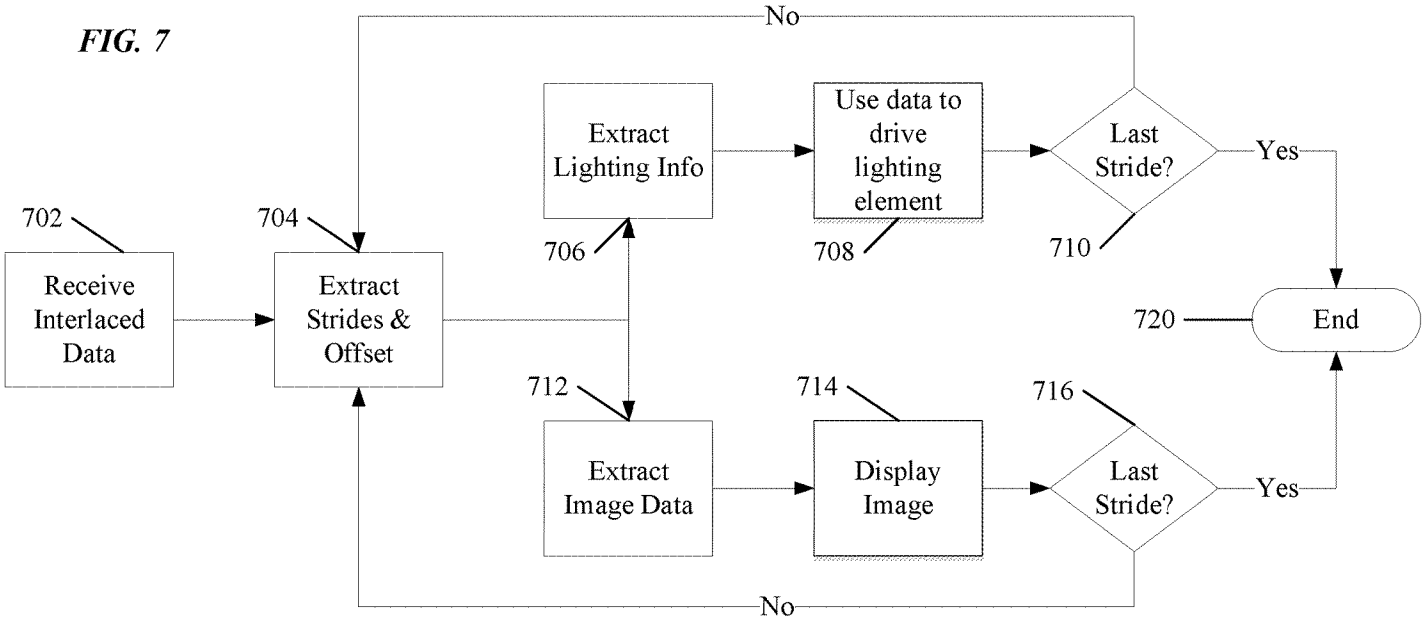
FIG. 7 is a process flow of an example of a process for interpreting data, such as the data depicted in FIG. 6, and utilizing interpreted data for control of a software configurable luminaire, such as the luminaire of FIG. 1.

FIG. 7 illustrates an example of a process flow utilized in conjunction with the interlaced format depicted in FIG. 6. In step 702, interlaced data is received or otherwise obtained by the processor of a lighting device. In step 704, a subset of data cells is identified based on a data header included with the interlaced data. For example, given the data header 602 with an offset of 2 depicted in FIG. 6, the first two data cells of the array data structure are identified and extracted from the array data structure. As part of step 704, also based on the data header, the nature or type of data contained in each data cell is identified. That is, again given the data header 602 depicted in FIG. 6, the first data cell is identified as corresponding to a display pixel (e.g., a first display data cell) and the second data cell is identified as corresponding to a lighting pixel (e.g., a first lighting data cell).

In step 706, lighting control information is extracted from the identified lighting data cell(s) corresponding to a lighting pixel (e.g., from the second data cell of FIG. 6). In turn, the extracted lighting control information, in step 708, is utilized to drive a corresponding light pixel. For example, the identified lighting data cell(s) contains chromaticity and intensity values depicted in an xyY format. Such chromaticity and intensity data can be utilized by the luminaire to drive the corresponding light pixel. In step 710, a determination is made as to whether the identified lighting data cell(s) is the last cell corresponding to a lighting pixel. If so, the process moves to step 720 and ends. If not, the process returns to step 704 and another subset of cells is identified.

In step 712, image data is extracted from the identified display data cell(s) corresponding to a display pixel (e.g., from the first display data cell of FIG. 6). In turn, the extracted image data, in step 714, is utilized to drive a corresponding display pixel. For example, the identified display data cell(s) contains RGB values defining a desired color to be produced by the corresponding display pixel. In step 716, a determination is made as to whether the identified cell(s) is the last cell corresponding to a display pixel. If so, the process moves to step 720 and ends. If not, the process returns to step 704.

As can be seen, steps 706, 708 and 710 are performed for data cells containing lighting control information and steps 712, 714 and 716 are performed for data cells containing image data. However, although not explicitly shown, if the obtained data only contains lighting control information, steps 712, 714 and 716 will not be performed. Similarly, if the obtained data only contains image data, steps 706, 708 and 710 will not be performed.

The interlaced format depicted in FIG. 6 in conjunction with the process flow depicted in FIG. 7 provides flexibility in maintaining interlaced image data and lighting control information. The examples of FIGS. 6-7 also provide an ability to arbitrarily change data to be utilized by a lighting device over time.

Figure 10:
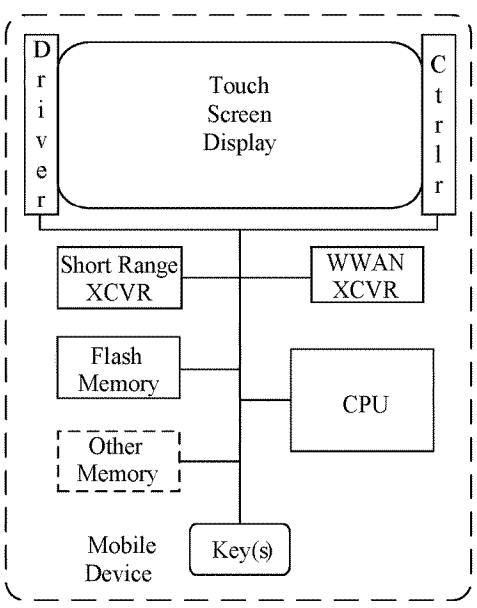
FIG. 10 is a simplified functional block diagram of a mobile device, as an alternate example of a user terminal device, for possible communication with a software configurable luminaire, for example, to exchange interlaced lighting control information and image data.
Figure 9:
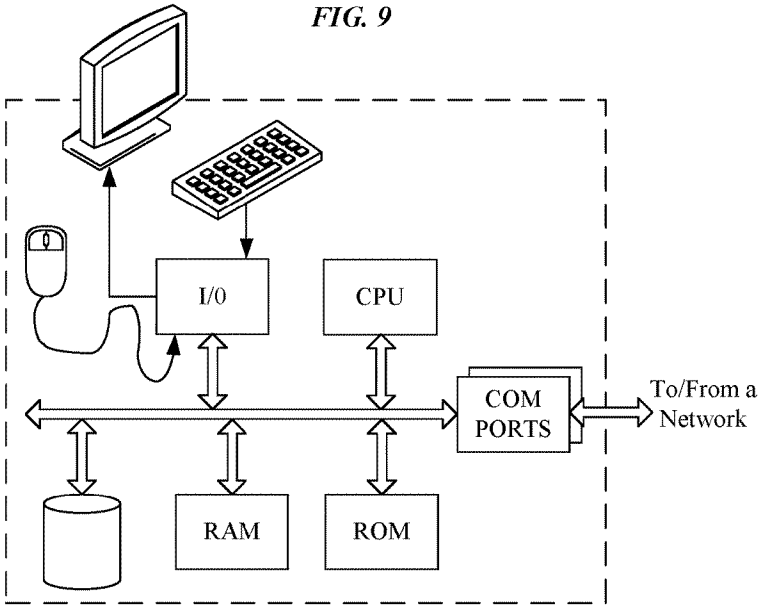
FIG. 9 is a simplified functional block diagram of a personal computer or other similar user terminal device, which may communicate with a software configurable luminaire, for example, to exchange interlaced lighting control information and image data.
Figure 8:
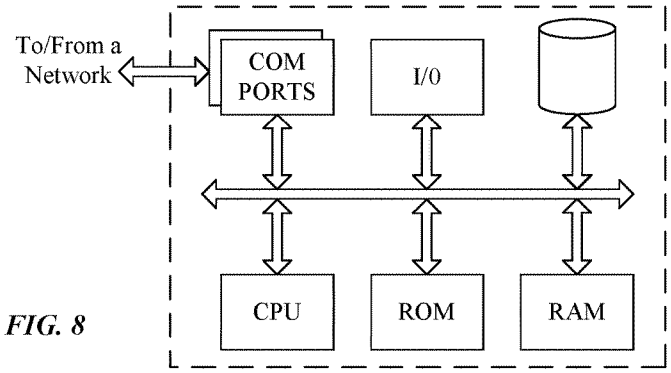
FIG. 8 is a simplified functional block diagram of a computer that may be configured as a host or server, for example, to supply interlaced lighting control information and image data to a software configurable luminaire, such as that of FIG. 1.

As shown by the above discussion, although many intelligent processing functions are implemented in lighting device, at least some functions may be implemented via communication with general purpose computers or other general purpose user terminal devices, although special purpose devices may be used. FIGS. 8-10 provide functional block diagram illustrations of exemplary general purpose hardware platforms.

FIG. 8 illustrates a network or host computer platform, as may typically be used to generate and/or receive lighting device 11 control commands, including data related to operation of the configurable luminaire, and access networks and devices external to the lighting device 11, such as multi-processor system 115 of FIG. 1 or implement light generation and control functionality of driver system 113. FIG. 9 depicts a computer with user interface communication elements, such as 117 as shown in FIG. 1, although the computer of FIG. 9 may also act as a server if appropriately programmed. The block diagram of a hardware platform of FIG. 10 represents an example of a mobile device, such as a tablet computer, smartphone or the like with a network interface to a wireless link, which may alternatively serve as a user terminal device for providing a user communication with a lighting device, such as 11. It is believed that those skilled in the art are familiar with the structure, programming and general operation of such computer equipment and as a result the drawings should be self-explanatory.

A server (see e.g. FIG. 8), for example, includes a data communication interface for packet data communication via the particular type of available network. The server also includes a central processing unit (CPU), in the form of one or more processors, for executing program instructions. The server platform typically includes an internal communication bus, program storage and data storage for various data files to be processed and/or communicated by the server, although the server often receives programming and data via network communications. The hardware elements, operating systems and programming languages of such servers are conventional in nature, and it is presumed that those skilled in the art are adequately familiar therewith. Of course, the server functions may be implemented in a distributed fashion on a number of similar platforms, to distribute the processing load. A server, such as that shown in FIG. 8, may be accessible or have access to a lighting device 11 via the communication interfaces 117 of the lighting device 11. For example, the server may deliver in response to a user request a configuration information file. Such configuration information file may contain data in an interlaced format, such as described above. The information of a configuration information file may be used to configure a software configurable lighting device, such as lighting device 11, to set light output parameters comprising: (1) light intensity, (2) light color characteristic and (3) spatial modulation, in accordance with the lighting device configuration information. In some examples, the lighting device configuration information include an image for display by the lighting device and at least one level setting for at least one of beam steering or beam shaping by the lighting device. The configuration information file may also include information regarding the performance of the software configurable lighting device, such as dimming performance, color temperature performance and the like. The configuration information file may also include temporal information such as when to switch from one beam shape or displayed image to another and how long the transition from one state to another should take. Configuration data may also be provided for other states, e.g., for when the virtual luminaire is to appear OFF, in the same or a separate stored data file.

A computer type user terminal device, such as a desktop or laptop type personal computer (PC), similarly includes a data communication interface CPU, main memory (such as a random access memory (RAM)) and one or more disc drives or other mass storage devices for storing user data and the various executable programs (see FIG. 9). A mobile device (see FIG. 10) type user terminal may include similar elements, but will typically use smaller components that also require less power, to facilitate implementation in a portable form factor. The example of FIG. 10 includes a wireless wide area network (WWAN) transceiver (XCVR) such as a 3G or 4G cellular network transceiver as well as a short range wireless transceiver such as a Bluetooth and/or WiFi transceiver for wireless local area network (WLAN) communication. The computer hardware platform of FIG. 8 and the terminal computer platform of FIG. 9 are shown by way of example as using a RAM type main memory and a hard disk drive for mass storage of data and programming, whereas the mobile device of FIG. 10 includes a flash memory and may include other miniature memory devices. It may be noted, however, that more modern computer architectures, particularly for portable usage, are equipped with semiconductor memory only.

The various types of user terminal devices will also include various user input and output elements. A computer, for example, may include a keyboard and a cursor control/selection device such as a mouse, trackball, joystick or touchpad; and a display for visual outputs (see FIG. 9). The mobile device example in FIG. 10 uses a touchscreen type display, where the display is controlled by a display driver, and user touching of the screen is detected by a touch sense controller (Ctrlr). The hardware elements, operating systems and programming languages of such computer and/or mobile user terminal devices also are conventional in nature, and it is presumed that those skilled in the art are adequately familiar therewith.

The user device of FIG. 9 and the mobile device of FIG. 10 may also interact with the lighting device 11 in order to enhance the user experience. For example, third party applications stored as programs 127 may correspond to control parameters of a software configurable lighting device, such as image display and general illumination lighting distribution. In addition, in response to the user controlled input devices, such as I/O of FIG. 9 and touchscreen display of FIG. 10, the lighting device, in some examples, is configured to accept input from a host of sensors, such as sensors 121. These sensors may be directly tied to the hardware of the device or be connected to the platform via a wired or wireless network. For example, a daylight sensor may be able to affect the light output from the illumination piece of the platform and at the same time change the scene of display as governed by the algorithms associated with the daylight sensor and the lighting platform. Other examples of such sensors can be more advanced in their functionality such as cameras for occupancy mapping and situational mapping.

The lighting device 11 in other examples is configured to perform visual light communication. Because of the beam steering (or steering) capability, the data speed and bandwidth can have an increased range. For example, beam steering and shaping provides the capability to increase the signal-to-noise ratio (SNR), which improves the visual light communication (VLC). Since the visible light is the carrier of the information, the amount of data and the distance the information may be sent may be increased by focusing the light. Beam steering allows directional control of light and that allows for concentrated power, which can be a requirement for providing highly concentrated light to a sensor. In other examples, the lighting device 11 is configured with programming that enables the lighting device 11 to "learn" behavior. For example, based on prior interactions with the platform, the lighting device 11 will be able to use artificial intelligence algorithms stored in memory 125 to predict future user behavior with respect to a space.

As also outlined above, aspects of the techniques for operation of a software configurable lighting device and any system interaction therewith, may involve some programming, e.g. programming of the lighting device, e.g. programming executing on the multi-processor system in the luminaire to implement the data processing functions to drive the display and light source as discussed above. Programming aspects may also include programming for a server or terminal device in communication with the lighting device. For example, the mobile device of FIG. 10 and the user device of FIG. 9 may interact with a server, such as the server of FIG. 8, to obtain a configuration information file, including interlaced data related to operation of the configurable luminaire (e.g., image data, illumination control data and/or modulation data), that may be delivered to a software configurable lighting device 11. Subsequently, the mobile device of FIG. 10 and/or the user device of FIG. 9 may execute programming that permits the respective devices to interact with the software configurable lighting device 11 to provide control commands such as the ON/OFF command or a performance command, such as dim or change beam steering angle or beam shape focus.

Program aspects of the technology discussed above therefore may be thought of as "products" or "articles of manufacture" typically in the form of executable code and/or associated data (software or firmware) that is carried on or embodied in a type of machine readable medium. Such program product may be utilized to generate and/or obtain interlaced data as described herein. Furthermore, such program product may utilize obtained interlaced data to control display and illumination functionality of a software configurable lighting device. "Storage" type media include any or all of the tangible memory of the luminaires, computers, processors or the like, or associated modules thereof, such as various semiconductor memories, tape drives, disk drives and the like, which may provide non-transitory storage at any time for the software or firmware programming. All or portions of the programming may at times be communicated through the Internet or various other telecommunication networks. Such communications, for example, may enable loading of the software from one computer or processor into another, for example, from a management server or host computer of the lighting system service provider into any of the lighting devices, sensors, user interface devices, other non-lighting-system devices, etc. of or coupled to the system 11 via communication interfaces 117, including both programming for individual element functions and programming for distributed processing functions. Thus, another type of media that may bear the software/firmware program elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible or "storage" media, terms such as computer or machine "readable medium" refer to any medium that participates in providing instructions to a processor for execution.

The term "coupled" as used herein refers to any logical, physical or electrical connection, link or the like by which signals produced by one system element are imparted to another "coupled" element. Unless described otherwise, coupled elements or devices are not necessarily directly connected to one another and may be separated by intermediate components, elements or communication media that may modify, manipulate or carry the signals.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A configurable luminaire, comprising:

a controllable, general illumination, light source, the light source comprising a plurality of light pixels;

a driver system coupled to the light source, the driver system being configured to supply drive power to the light source in a manner to control general illumination light output by each pixel of the light source; and a processor coupled to the driver system, wherein:

data related to operation of the configurable luminaire comprises data representing lighting control information for general illumination light output;

the data related to operation of the configurable luminaire is separable into portions, each of at least some of the portions containing data representing lighting control information; and the processor is configured to implement functions, including functions to:

obtain each portion containing data representing lighting control information, wherein the implemented function to obtain each portion comprises includes:

obtaining, from a first pre-defined channel within the data, a first light output value for a parameter of general illumination light output, and obtaining, from a second pre-defined channel within the data, a second light output value for another parameter of general illumination light output, the first and second light output values forming the respective portion; and for each obtained portion, control a corresponding one light pixel based on the respective portion for general illumination light output by the light source, wherein the implemented function to control the corresponding one light pixel includes:

controlling, based on the first light output value of the respective portion, an intensity of light output from the corresponding one light pixel; and controlling, based on the second light output value of the respective portion, a coordinated color temperature of light output from the corresponding one light pixel.

2. A configurable luminaire, comprising:

a controllable, general illumination, light source, the light source comprising a plurality of light pixels;

a driver system coupled to the light source, the driver system being configured to supply drive power to the light source in a manner to control general illumination light output by each pixel of the light source; and a processor coupled to the driver system, wherein:

data related to operation of the configurable luminaire comprises data representing lighting control information for general illumination light output;

the data related to operation of the configurable luminaire is separable into portions, each of at least some of the portions containing data representing lighting control information; and the processor is configured to implement functions, including functions to:

obtain each portion containing data representing lighting control information, wherein the implemented function to obtain each portion includes:

obtaining, from a first pre-defined channel within the data, a first light output value for a parameter of general illumination light output;

obtaining, from a second pre-defined channel within the data, a second light output value for a second parameter of general illumination light output;

obtaining, from a third pre-defined channel within the data, a third light output value for a third parameter of general illumination light output; and obtaining, from a fourth pre-defined channel within the data, a fourth light output value for a fourth parameter of general illumination light output, the first, second, third, and fourth light output values forming the respective portion; and for each obtained portion, control a corresponding one light pixel based on the respective portion for general illumination light output by the light source, wherein the implemented function to control the corresponding one light pixel includes:

controlling, based on the three light output values of the respective portion, a coordinated color temperature of light output from the corresponding one light pixel; and controlling, based on the fourth light output value of the respective portion, an intensity of light output from the corresponding one light pixel.

3. A configurable luminaire, comprising:

a controllable, general illumination, light source, the light source comprising a plurality of light pixels;

a display comprising a plurality of display pixels and being configured to present an image, wherein the light source and the display are collocated within the configurable luminaire to allow passage of general illumination light output from the light source and image light output from the display through a common output area or surface of the configurable luminaire;

a driver system coupled to the light source and the display, the driver system being configured to:

supply drive power to the light source in a manner to control general illumination light output by each pixel of the light source; and control presentation of the image via the display; and a processor coupled to the driver system, wherein:

data related to operation of the configurable luminaire comprises data representing lighting control information for general illumination light output and data representing the image;

the data related to operation of the configurable luminaire is separable into portions, each portion containing data representing lighting control information or data representing the image;

each portion containing data representing lighting control information corresponds to one light pixel;

each portion containing data representing the image corresponds to one display pixel; and the processor is configured to implement functions, including functions to:

obtain each portion;

for each portion containing data representing lighting control information, control the corresponding one light pixel based on the respective portion for general illumination light output by the light source; and for each portion containing data representing the image, control the corresponding one display pixel based on the respective portion for presentation of the image via the display.

4. The configurable luminaire of claim 3, wherein the implemented function to obtain each portion comprises functions, including functions to:

for each portion containing data representing the image:

obtain, from a first pre-defined channel within the data, a first light output value for a first image display parameter;

obtain, from a second pre-defined channel within the data, a second light output value for a second image display parameter; and obtain, from a third pre-defined channel within the data, a third light output value for a third image display parameter; and for each portion containing data representing control information:

obtain, from a fourth pre-defined channel within the data, a fourth light output value for a parameter of general illumination light output.

5. The configurable luminaire of claim 4, wherein:

the implemented function to control the corresponding one display pixel further comprises functions to:

control, based on the first light output value, an amount of red to be output by the one display pixel;

control, based on the second light output value, an amount of green to be output by the one display pixel; and control, based on the third light output value, an amount of blue to be output by the one display pixel; and the implemented function to control the corresponding one light pixel further comprises a function to control, based on the fourth light output value, an intensity of light output from the corresponding one light pixel.

6. The configurable luminaire of claim 3, wherein the implemented function to obtain each portion comprises functions, including functions to:

for each portion:

obtain, from a first pre-defined channel within the data, a first light output value;

obtain, from a second pre-defined channel within the data, a second light output value;

obtain, from a third pre-defined channel within the data, a third light output value; and determine whether the first light output value, the second light output value and the third light output value are each greater than 1.

7. The configurable luminaire of claim 6, wherein the implemented function to control the corresponding one display pixel comprises functions, including functions to:

upon determining the first light output value, the second light output value and the third light output value are not each greater than 1:

control, based on the first light output value, an amount of red to be output by the one display pixel;

control, based on the second light output value, an amount of green to be output by the one display pixel; and control, based on the third light output value, an amount of blue to be output by the one display pixel.

8. The configurable luminaire of claim 6, wherein the implemented function to control the corresponding one light pixel comprises a function to:

upon determining the first light output value, the second light output value and the third light output value are each greater than 1, control, based on the three light output values, an intensity and a coordinated color temperature of light output from the corresponding one light pixel.

9. The configurable luminaire of claim 3, wherein the implemented function to obtain each portion comprises functions, including functions to:

obtain a data header defining a relationship between cells of an array, the array containing the data to be obtained and the relationship including:

an indication of a number of cells contained in one portion corresponding to one display pixel;

an indication of a number of cells contained in one portion corresponding to one light pixel; and an indication of an offset, the offset being the summation of the number of cells corresponding to one display pixel and the number of cells corresponding to one light pixel; and for each offset within the array:

obtain, based on the relationship, a first portion corresponding to one display pixel; and obtain, based on the relationship, a second portion corresponding to one light pixel.

10. A method, comprising:

obtaining, from data related to operation of a configurable luminaire and separable into portions, each portion of the data by:

obtaining, from a first pre-defined channel within the data, a first light output value for a parameter of general illumination light output; and obtaining, from a second pre-defined channel within the data, a second light output value for another parameter of general illumination light output, the first and second light output values forming the respective portion;

wherein:

the configurable luminaire comprises:

a controllable, general illumination, light source comprising a plurality of light pixels;

a driver system coupled to the light source and configured to supply drive power to the light source in a manner to control general illumination light output by the light source; and a processor coupled to the driver system;

the data comprises data representing control information for general illumination light output; and each portion containing data representing control information corresponds to one light pixel; and for each portion containing data representing control information, controlling a corresponding light pixel based on the respective portion for general illumination light output by the light source by:

controlling, based on the first light output value of the respective portion, an intensity of light output from the corresponding one light pixel; and controlling, based on the second light output value of the respective portion, a coordinated color temperature of light output from the corresponding one light pixel.

11. A method, comprising:

obtaining, from data related to operation of a configurable luminaire and separable into portions, each portion of the data by:

obtaining, from a first pre-defined channel within the data, a first light output value for a first parameter of general illumination light output;

obtaining, from a second pre-defined channel within the data, a second light output value for a second parameter of general illumination light output;

obtaining, from a third pre-defined channel within the data, a third light output value for a third parameter of general illumination light output; and obtaining, from a fourth pre-defined channel within the data, a fourth light output value for a fourth parameter of general illumination light output, the first, second, third, and fourth light output values forming the respective portion;

wherein:

the configurable luminaire comprises:

a controllable, general illumination, light source comprising a plurality of light pixels;

a driver system coupled to the light source and configured to supply drive power to the light source in a manner to control general illumination light output by the light source; and a processor coupled to the driver system;

the data comprises data representing control information for general illumination light output and each portion containing data representing control information corresponds to one light pixel; and for each portion containing data representing control information, controlling a corresponding light pixel based on the respective portion for general illumination light output by the light source by:

controlling, based on the three light output values of the respective portion, a coordinated color temperature of light output from the corresponding one light pixel; and controlling, based on the fourth light output value of the respective portion, an intensity of light output from the corresponding one light pixel.

12. A method, comprising:

obtaining, from data related to operation of a configurable luminaire and separable into portions, each portion of the data, wherein:

the configurable luminaire comprises:

a controllable, general illumination, light source comprising a plurality of light pixels;

a display comprising a plurality of display pixels and being configured to present an image, wherein the light source and the display are collocated within the configurable luminaire to allow passage of general illumination light output from the light source and image light output from the display through a common output area or surface of the configurable luminaire;

a driver system coupled to the light source and the display, the driver system configured to:

supply drive power to the light source in a manner to control general illumination light output by the light source; and control presentation of the image via the display; and a processor coupled to the driver system;

the data comprises data representing control information for general illumination light output and data representing the image;

each portion containing data representing control information corresponds to one light pixel; and each portion containing data representing the image corresponds to one display pixel;

for each portion containing data representing control information, controlling the corresponding light pixel based on the respective portion for general illumination light output by the light source; and for each portion containing data representing the image, controlling the corresponding one display pixel based on the respective portion for presentation of the image via the display.

13. The method of claim 12, wherein obtaining each portion of the data comprises:

for each portion containing data representing the image:

obtaining, from a first pre-defined channel within the data, a first light output value for a first image display parameter;

obtaining, from a second pre-defined channel within the data, a second light output value for a second image display parameter; and obtaining, from a third pre-defined channel within the data, a third light output value for a third image display parameter; and for each portion containing data representing control information:

obtain, from a fourth pre-defined channel within the data, a fourth light output value for a parameter of general illumination light output.

14. The method of claim 12, wherein obtaining each portion of the data comprises:

obtaining a data header defining a relationship between cells of an array, the array containing the data to be obtained and the relationship including:

an indication of a number of cells contained in one portion corresponding to one display pixel;

an indication of a number of cells contained in one portion corresponding to one light pixel; and an indication of an offset, the offset being the summation of the number of cells corresponding to one display pixel and the number of cells corresponding to one light pixel; and for each offset within the array:

obtaining, based on the relationship, a first portion corresponding to one display pixel; and obtaining, based on the relationship, a second portion corresponding to one light pixel.

15. A tangible, non-transitory computer readable medium comprising data related to operation of a configurable luminaire, wherein:

the data comprises:

data representing control information for general illumination light output of a controllable, general illumination, light source comprising a plurality of light pixels; and data representing an image for presentation by a display comprising a plurality of display pixels, wherein the light source and the display collocated within the configurable luminaire to allow passage of general illumination light output from the light source and image light output from the display through a common output area or surface of the configurable luminaire;

the data is separable into portions, each portion containing data representing lighting control information or data representing the image;

each portion containing data representing control information corresponds to one light pixel; and each portion containing data representing the image corresponds to one display pixel.

* * * * *